US008135325B2

(12) United States Patent
Biegelsen

(10) Patent No.: US 8,135,325 B2
(45) Date of Patent: Mar. 13, 2012

(54) IMAGE-DRIVABLE FLASH LAMP

(75) Inventor: David K. Biegelsen, Portola Valley, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 431 days.

(21) Appl. No.: 12/365,825

(22) Filed: Feb. 4, 2009

(65) Prior Publication Data

US 2010/0196067 A1 Aug. 5, 2010

(51) Int. Cl.
*G03G 15/20* (2006.01)

(52) U.S. Cl. ..... 399/336

(58) Field of Classification Search ..... 399/107, 399/110, 122, 320, 335, 336; 219/216, 619; 345/60

See application file for complete search history.

(56) References Cited

U.S. PATENT DOCUMENTS

| | | | | |
|---|---|---|---|---|
| 6,453,145 | B1 * | 9/2002 | Miura | 399/336 |
| 6,813,465 | B2 * | 11/2004 | Kishimoto et al. | 399/336 |
| 6,999,711 | B2 * | 2/2006 | Suzuki et al. | 399/336 |
| 7,430,395 | B2 * | 9/2008 | Iwaishi et al. | 399/336 |
| 2007/0103391 | A1 * | 5/2007 | Kao et al. | 345/60 |

* cited by examiner

*Primary Examiner* — Hoan Tran
(74) *Attorney, Agent, or Firm* — Marger Johnson & McCollom, P.C.

(57) ABSTRACT

A flash lamp including an integrated plurality of pixels. Each pixel includes a transparent first electrode; a cell including a gas coupled to the transparent first electrode; and a second electrode having a non-uniform surface coupled to the cell.

19 Claims, 6 Drawing Sheets

IMAGE-DRIVABLE FLASH LAMP

BACKGROUND

This disclosure relates to flash lamps, imaging systems using flash lamps, and more particularly, image-drivable flash lamps and imaging systems using the same.

Flash fusing is desirable for high speed printing but is quite energy intensive. Flash fusing can use a flash lamp. Such flash lamps are commonly configured as long tubes using reflective optics to transmit as much light as possible into a flat illumination field. A driver circuit for such a flash lamp uses a fast discharge, large valued capacitor to drive the flash lamp. However, such capacitors and their related power supplies can be difficult to manufacture and thus can be expensive. Moreover, the design of a flash lamp tends to compromise between uniformity of illumination and system cost.

Furthermore, such flash lamps indiscriminately illuminate a substrate. As a result, non-imaged regions of the substrate are heated and dried out unnecessarily as there is not marking material present to absorb the energy from the flash lamp.

SUMMARY

An embodiment includes a flash lamp including a plurality of pixels. Each pixel includes a transparent first electrode; a cell including a gas coupled to the transparent first electrode; and a second electrode having a non-uniform surface coupled to the cell.

Another embodiment includes an imaging system including an image transfer structure configured to image-wise apply marking material to a substrate; and a flash lamp configured to fuse the marking material to the substrate including a plurality of pixels. Each pixel includes a transparent first electrode; a cell including a gas coupled to the transparent first electrode; and a second electrode having a non-uniform surface coupled to the cell.

Another embodiment includes a method of imaging using a flash lamp including image-wise depositing marking material on a substrate; and image-wise irradiating the substrate to fuse the marking material to the substrate by image-wise discharging current through cells of the flash lamp.

DETAILED DESCRIPTION

Embodiments will be described in reference to the drawings. In an embodiment, a flash lamp can be pixelated. That is, instead of a serpentine tubular structure, the flash lamp can be formed from multiple pixels, were individual pixels and/or groups of pixels can be independently addressable. In particular, each pixel can function as a gas discharge lamp.

Figure 1:
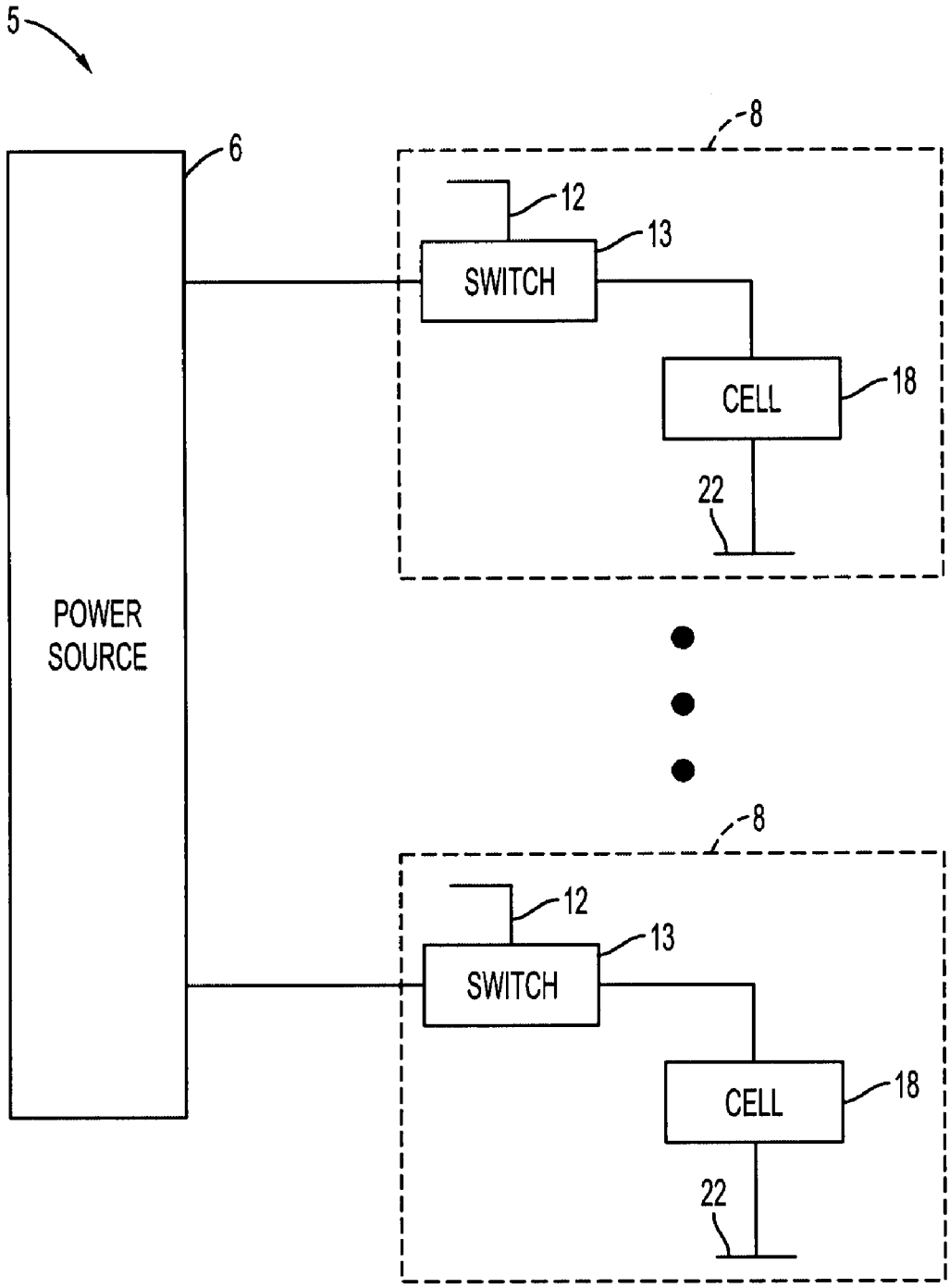
FIG. 1 is a block diagram of a flash lamp according to an embodiment.

FIG. 1 is a block diagram of a flash lamp according to an embodiment. The flash lamp 5 includes a power source 6, multiple switches 13, and multiple cells 18. Each switch 13 and cell 18 can form a pixel 8 of the flash lamp 5. Each switch 13 is responsive to a control line 12.

The power source 6 can be any variety of power sources. For example, the power source 6 can be a terminal of a power supply, a capacitor, an inductor, an array of such elements, or the like. Any power source that can supply current to the cells 18 at a desired voltage can be used as a power source.

In a pixel 8, the switch 13 is configured to control the current to the corresponding cell 18. The cell 18 is configured to radiate in response to current supplied to the cell 18. Each pixel 8 can have a corresponding control line 12 coupled to the switch 13. As a result, the discharge of current through the cells 18 can be independently controlled. Accordingly, the radiation from individual cells 18 and hence individual pixels 8 can be independently controlled.

A flash lamp 5 formed from such pixels 8 can have a variety of applications. For example, as will be described in further detail below, a flash lamp 5 can be part of an imaging system. In another embodiment, the flash lamp 5 can be used in semiconductor processing such as in photolithography, annealing, or the like. In another embodiment, the flash lamp can be used in a germicidal application for selective irradiation of a sample.

Such a flash lamp 5 can have a variety of illumination patterns. For example, as will be described in further detail below, the pixels 8 of the flash lamp 5 can be energized based on an image deposited on a substrate. As the flash lamp 5 includes individually addressable pixels 8, the flash lamp 5 can be energized such that the irradiation on a substrate is correlated with an image deposited on the substrate.

However, the irradiation of the flash lamp 5 need not be dependent on the substrate or a characteristic of the substrate. For example, the illumination pattern can be varied in space and time. Examples include irradiating different cells of a biological array with different numbers of flashes or with different intensities; sweeping lines of illumination across an object; or creating collapsing or expanding rings of irradiation. Such variation need not be related to the cells of the biological array or any samples contained within. Any application where irradiation of an entire surface, substrate, field, or the like is not necessary, or where time and/or space varying irradiation of such surface, substrate, field, or the like is desired, or where spatial calibration of the irradiation is desirable, can be implemented using a pixelated flash lamp as described herein.

Figure 2:
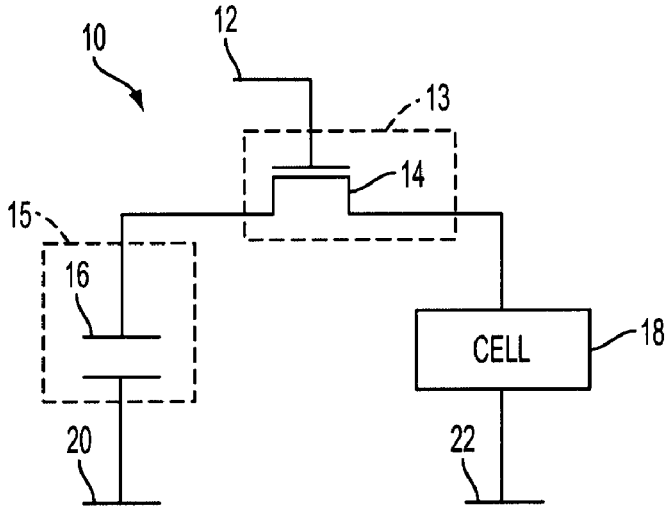
FIG. 2 is a schematic diagram of a pixel of a flash lamp according to an embodiment.

FIG. 2 is a schematic diagram of a pixel of a flash lamp according to an embodiment. The pixel 10 includes a storage element 15, a switch 13, and a cell 18. The switch 13 is coupled to a control line 12. In this embodiment, the storage element 15 is a capacitor 16. The capacitor 16 is coupled between a first power source 20 and the switch 13. The cell 18 is coupled between the switch 13 and a second power source 22.

Accordingly, the switch 13 can be used to allow the capacitor 16 to discharge through the cell 18. As will be described in further detail below, the cell 18 can be filled with a gas to operate as a gas discharge lamp. As a flash lamp can be formed from multiple pixels 10, the flash lamp can effectively be formed monolithically from multiple independently addressable gas discharge lamps.

As described above, the storage element 15 can be a capacitor 16. The capacitor 16 can be any variety of capacitors. In an embodiment, the capacitor 16 can be an electric double-layer capacitor, super-capacitor, ultra-capacitor, or any other high energy density capacitor.

In an embodiment, the switch 13 can be a transistor 14. The transistor 14 can be any variety of transistors. For example, the transistor 14 can be monocrystalline, polycrystalline, amorphous-silicon transistors, or the like. The transistor 14 can be thin-film transistors, such as thin-film field effect transistors (FET). Any type of transistor can be used, provided that the transistor 14 can withstand the voltage and current requirements of discharge through the cell 18.

The switch 13 is not limited to the transistor 14. For example, the switch 13 can be a circuit including multiple transistors. In another example, the switch 13 can be a relay, such as a microelectromechanical system (MEMS) relay. The switch 13 can be any variety of structures that can control the flow of current.

The first power source 20 and the second power source 22 can be any variety of power sources. For example, the first power source 20 can be a terminal of a power supply and the second power source 22 can be a ground. Any power source that can supply current to the storage element 15 can be used as a power source. Moreover, even though first and second power sources 20 and 22 have been described as separate, the first and second power sources 20 and 22 can be part of a single power source. For example, the first and second power sources 20 and 22 can be terminals of a single power supply.

Figure 3:
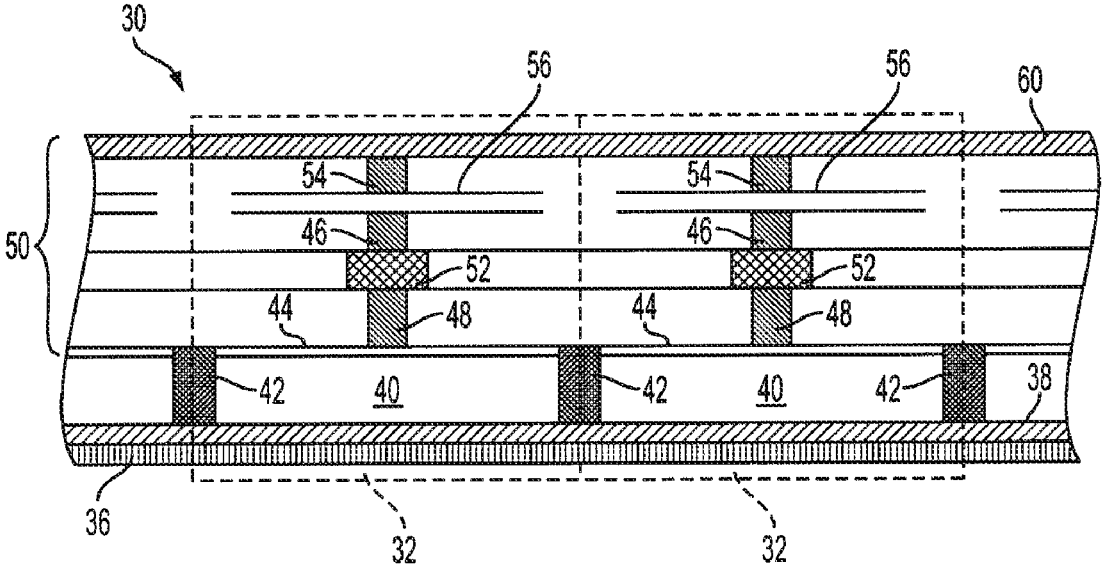
FIG. 3 is a cross-sectional view of a pixelated flash lamp according to an embodiment.

FIG. 3 is a cross-sectional view of a pixelated flash lamp according to an embodiment. The flash lamp 30 has a layered structure. That is, the flash lamp 30 can be formed using printed circuit board fabrication techniques, semiconductor fabrication techniques, or other similar techniques.

In FIG. 3, two pixels 32 are illustrated. Each pixel 32 includes a cell 40. The cell 40 is bounded by a common electrode 38 and a pixel electrode 44. In an embodiment, the common electrode 38 can be an electrode for multiple pixels 32; however, the pixel electrodes 44 are electrically isolated. That is, each pixel electrode 44 can be independently energized such that discharge through the corresponding cells 40 can be independently controlled.

Within the cell 40 is a gas. In particular, the gas can be a noble gas, such as xenon, krypton, or the like. Accordingly, when a current is discharged through the cell 40, light can be generated in the cell as in a gas discharge lamp. To allow such light to pass, the common electrode 38 can be substantially transparent to any light to be emitted. For example, the common electrode 38 can be gold, indium-tin-oxide, or the like. In an embodiment, the common electrode 38 can be covered by a layer 36. Such a layer 36 can also be substantially transparent to any emitted light. For example the layer 36 can be glass. In an embodiment, layer 36 can form a protective layer. That is, the layer 36 can protect the common electrode 38 from contamination, wear, or the like.

In an embodiment, the cell 40 can be hermetically sealed. Thus, the gas within can be prevented from escaping or being contaminated, reducing the effective life of the flash lamp 30. In an embodiment, the array of pixels 32 can be hermetically sealed. That is, each individual cell 40 of a pixel 32 need not be hermetically sealed, but the pixels 32 as a whole, in groups, or the like can be hermetically sealed. As a result, the gas of one cell 40 may mingle with the gas of another. In addition the pixel electrodes 44 can include a coating substantially impermeable to the gas. Such a coating can contribute to the hermetic seal of each cell 40, the array of pixels, or the like. In an embodiment, layer 36 and at least the side of printed circuit board 50 adjacent to cells 40 can be substantially impermeable. For example, as described above, layer 36 can be glass. An adjacent layer of PCB 50 can be glazed ceramic. Accordingly, layer 36 and the PCB 50 can be substantially impermeable to gas, forming a hermetic seal around the cells 40.

The spacer 42 offsets the common electrode 38 from the pixel electrodes 44. This creates the opening of the cell 40 for the gas. The spacer 42 can form a perimeter of each cell 40, and contribute to a hermetic seal of the cell 40, as described above. In another embodiment, since the cells 40 are not hermetically sealed from one another, the spacer 42 can, but need not isolate the cells 40 from each other. That is, the spacer 42 can be a structure that allows the gas of the cells 40 to pass from one cell to another. For example, instead of a wall forming the spacer 42, the spacer 42 can be a post, column, or the like. However, even with spacers 42 that do not isolate the cells 40 from one another, a hermetic seal can be maintained. For example, spacers 42 forming the outer perimeter of cells 40 and/or other structures along the outer perimeter can be made impermeable.

In an embodiment, the cells 40 can be coupled to a printed circuit board (PCB) 50. For example, the PCB 50 can be a ceramic PCB. The pixel electrodes 44 can be part of the PCB 50. The PCB 50 can include multiple layers for other circuitry. In particular, a via 48 couples the pixel electrode 44 to the transistor 52. A via 46 couples the transistor 52 to a capacitor 56. A via 54 couples the capacitor 56 to a layer 60. Layer 60 can be coupled to a terminal of a power source.

In an embodiment, each capacitor 56 can be charged to a voltage of the power source. For example the charging can occur through layer 60, through the layer including transistors 52, or the like. In particular, the charging can occur during a period that transistor 52 is turned off. Each transistor 52 can then be addressed by electrodes (not illustrated) which are driven in turn by a controller (not illustrated). As a result, the transistors 52 can be individually switched to conduct to actuate the pixel 32.

In an embodiment, each pixel 32 includes a corresponding capacitor 56. The capacitor 56 can be coupled to the transistor 52 through a via 54. To energize the cell 40, the transistor 52 is turned on to discharge the capacitor 56 through the cell 40. Since each pixel 32 includes its own capacitor 56, each cell 40 can be energized individually through individual control of the corresponding transistor 52. Moreover, when recharging the capacitors 56 for a subsequent discharge, only those capacitors 56 that were discharged are recharged. That is, if the flash lamp 30 is image-wise actuated, only those capacitors 56 of actuated pixels 32 need to be recharged. As a result power consumption can be reduced.

Although the capacitors 56 have been illustrated as part of the PCB 50, the capacitors 56 can be separate structures coupled to the PCB 50. For example, the capacitors 56 can be integrated into the PCB 50 stack as illustrated, soldered to the PCB 50 as discrete components, or the like.

In an embodiment, the layer 60 can be an electrode for multiple capacitors 56. However, the other electrodes of the capacitors 56 can still be independent so that independent operation can be maintained. In addition, in an embodiment, there need not be a one-to-one relationship between a capacitor 56 and a pixel 32. That is, one capacitor can be coupled to multiple pixels 32. Accordingly, the flash lamp 30 can still be image-wise energized, but a number of capacitors per pixel can be reduced.

As described above, where there is one capacitor 56 per pixel 32, each cell 40 has a corresponding pixel. In an embodiment, the energy stored on the capacitor 56 can be discharged through the cell 40 as long as the capacitor 56 can deliver a sufficient amount of energy to maintain an ionized state in the cell 40. Accordingly, the capacitor 56 can be sized such that a desired amount of light, whether in time, intensity, or the like, is emitted from the cell 40.

Where there are multiple pixels 32 coupled to a single capacitor 56, the single capacitor 56 can be sized such that it can store a sufficient amount of energy to actuate all of the cells 40 coupled to it. Thus, the energy available to discharge through a single cell 40 can be the entire amount stored on the capacitor 56. Accordingly, the timing, resistivity, or the like of the corresponding transistor 52 can be controlled such that an amount of energy is discharged through the cell 40 to achieve the desired amount of light.

As a result of such a distributed arrangement of pixels 32, capacitors 56, cells 40, or the like, the current used to energize the flash lamp 30 is distributed. That is, the current flowing through a particular pixel 32 is only the current necessary to actuate that pixel 32, not the other pixels 32 of the flash lamp 30. Accordingly, the current density flowing in any one particular portion of the flash lamp 30 is reduced. In contrast, in a tubular flash lamp with two electrodes, all of the current delivered to energize the flash lamp is delivered through those two electrodes. As a result, the current density is correspondingly higher.

The flash lamp 30 can take a variety of forms. For example, in an embodiment, as the flash lamp 30 can be formed on a PCB 50, the flash lamp 30 can be a planar structure. That is, the flash lamp 30 can be formed as a planar sheet of pixels 32. In another embodiment, the flash lamp 30 can be a formed as a curved two-dimensional or three-dimensional surface. For example, the flash lamp 30 can be formed on a drum, roller, sphere or the like. In another embodiment, the flash lamp 30 can be a linear array of pixels 32. Similarly, such pixels 32 can be aligned along a straight line, a curved line, or the like.

Figure 4:
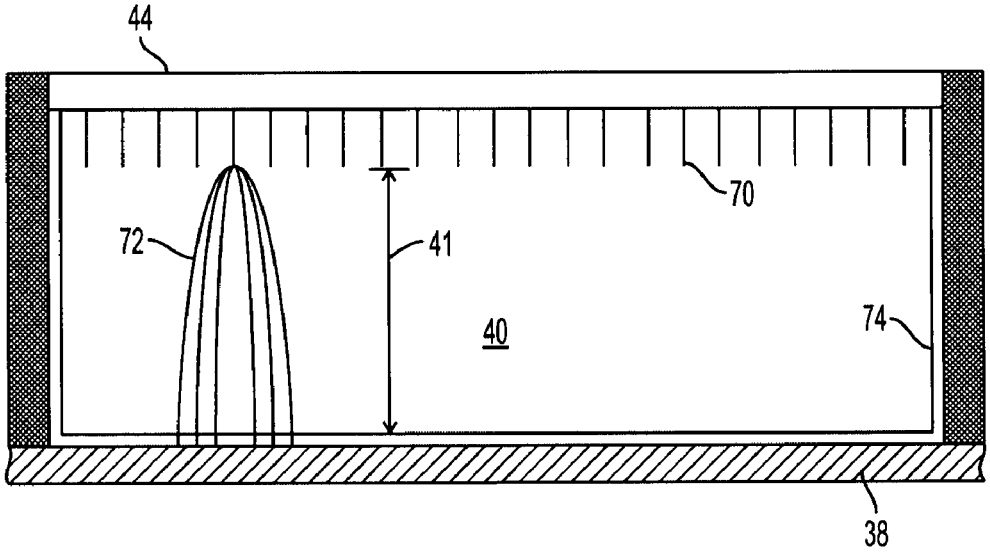
FIG. 4 is a cross-sectional view of an example of a cell of the flash lamp of FIG. 3.

FIG. 4 is a cross-sectional view of an example of a cell of the flash lamp of FIG. 3. In particular, in an embodiment, the pixel electrode 44 can have a substantially non-uniform surface. For example, the pixel electrode 44 can include nano-wires 70. The nano-wires 70 can be, for example, carbon nano-tubes. The nano-wires 70 can be disposed to be perpendicular to the plane of the pixel electrode 44. The nano-wires 70 can be deposited on the pixel electrode 44 in a variety of ways. For example, the nano-wires 70 can be grown by chemical vapor deposition, using a catalyst layer consisting of an island structured thin metal layer or a monolayer of nano-particles, or the like.

In an embodiment, the nano-wires 70 can be conducting nano-wires. However, in another embodiment, the nano-wires 70 can be semiconducting nano-wires. That is, the nano-wires can have some resistance. As a result, the resistance will limit the current flowing through the cell and can correspondingly provide protection and/or make the discharge more uniform throughout the cell 40.

In gas discharge lamps, the atoms of the gas are induced into an ionized state. Typically a high voltage is necessary to achieve the ionized state. However, the structure of the cell 40 can allow for a lower voltage to be used to induce the ionization. In particular, the reduced dimensions of the cell 40 bring the electrodes 38 and 44 closer together. As a result, a similar electric field can be achieved in the gas to induce ionization as in other gas discharge lamps with a lower voltage. That is, the lower voltage across the smaller distance can achieve a similar electric field strength. For example, the cell 40 may have a height 41 that is about 1 mm. Accordingly, a spacing of the electrodes of a pixel 32 can be smaller than a spacing of electrodes for a tubular flash lamp.

Moreover, the use of nano-wires 70 can reduce the voltage necessary to achieve ionization. For example, the tips of nano-wires 70 can be relatively fine. As a result, a voltage that can generate an electric field sufficient to ionize the gas can be lower than conventional gas discharge lamps. The electric field for one nano-wire 70 is illustrated by field 72. The field 72 is concentrated near the tips of the nano-wire 70. As a result, ionization can occur at the tip with a relatively low voltage since most of the electric field is concentrated near the tips. The ionization can propagate from the tips of the nano-wires 70 through the remainder of the cell 40. Accordingly, not only does a reduced distance between electrodes decrease a voltage necessary for ionization, but the increased field strength at the tip of the nano-wires 70 further decreases the necessary voltage and provides high cold-cathode field-emitted electrical currents. As a result, lower voltage components and substrates, or the like can be used.

Moreover, the reduced distance and/or the non-uniform surface of the pixel electrode 44 can simplify the architecture of the flash lamp 30. As the decreased distance and non-uniformity can increase the capability of the cell 40 to ionize the gas, a separate triggering circuitry and/or structure is not necessary. That is, the pixels 32 can self-trigger due to the decreased voltage and/or increase electric field strengths for a given voltage.

In an embodiment, the electrode 38, spacers 42, and other structures bounding a cell 40 can be chosen from materials which reduce recombination of the excited or ionized gas. For example, the electrode 38 and spacers 42 can include a coating 74 configured to reduce recombination and/or de-excitation of the gas at the surfaces of the electrode 38 and spacers 42. At the surfaces ionized atoms of the gas may be induced to recombine with electrons and emit energy in wavelengths that are not desired. That is, the electrode 38 may induce an undesired recombination and/or decay of an energy state of the gas. A coating 74, such as parylene can prevent such recombination.

In an embodiment, such coatings 74 can be formed to achieve the reduction in recombination yet also allow conduction to the electrode 38. For example, the coating 74 can be formed to be porous, conducting, or the like. In particular, the coating 74 on the electrode 38 can be formed to sufficiently pass a desired current. As a result, more of the energy introduced into the gas to achieve the excited states can be emitted at the desired wavelengths, rather than through undesired or non-light emitting recombination.

In an embodiment, the gas of a cell 40 can be in ohmic contact with the common electrode 38, the pixel electrode 44, or the like. Accordingly, a barrier between the gas and the electrodes need not be overcome.

Figure 5:
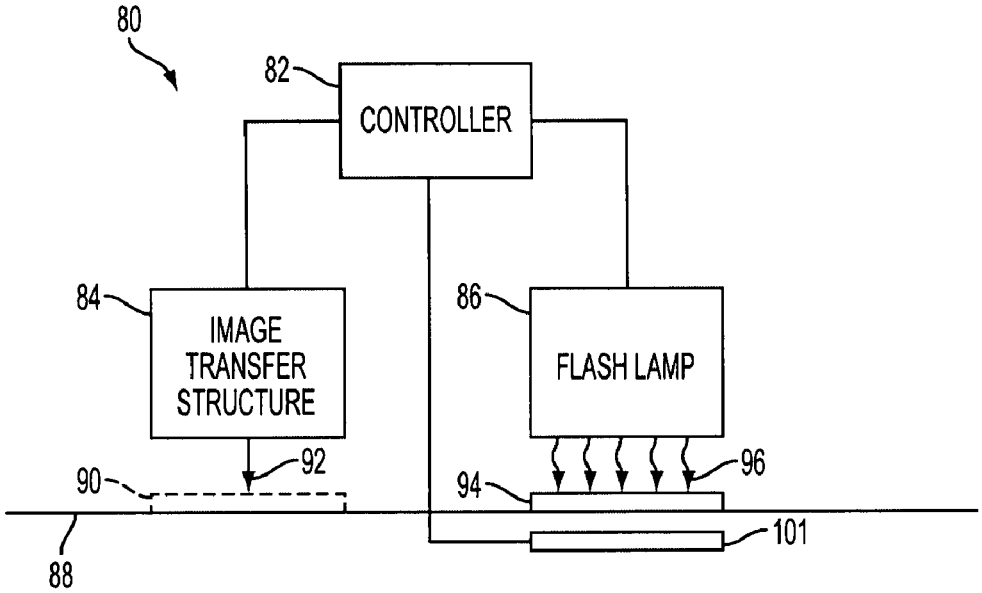
FIG. 5 is a block diagram of an imaging system using a flash lamp according to an embodiment.

FIG. 5 is a block diagram of an imaging system using a flash lamp according to an embodiment. The imaging system 80 includes an image transfer structure 84 and a flash lamp 86. The image transfer structure 84 is configured to image-wise apply marking material 92 to a substrate 90. Substrate 90 is illustrated as receiving the marking material 92 from the image transfer structure 84. The flash lamp 86 is configured to fuse the marking material to the substrate 94. The flash lamp 86 can be a flash lamp as described above. A substrate transport system 88 is configured to move the substrate 90 into a position relative to the flash lamp 86 as indicated by substrate 94. The flash lamp 86 is configured to irradiate the substrate 94 as illustrated by radiation 96.

As described above, each pixel of the flash lamp 86 can be energized. The controller 82 can be configured to image-wise energize the pixels, for example, by discharging the capacitors of the pixels through the corresponding cells. As a result the energy 96 emitted by the flash lamp 86 can image-wise irradiate the substrate 94. As a result, the marking material on the substrate 94 can be image-wise fused to the substrate 94.

In an embodiment in which the capacitors of the pixels of the flash lamp 86 can be image-wise addressed, only those pixels which have been fully or partially discharged need recharging. Accordingly, the controller 82 can be configured to image-wise recharge the capacitors. That is, the controller 82 can be configured to recharge only those capacitors that were discharged according to the image.

Figure 6:
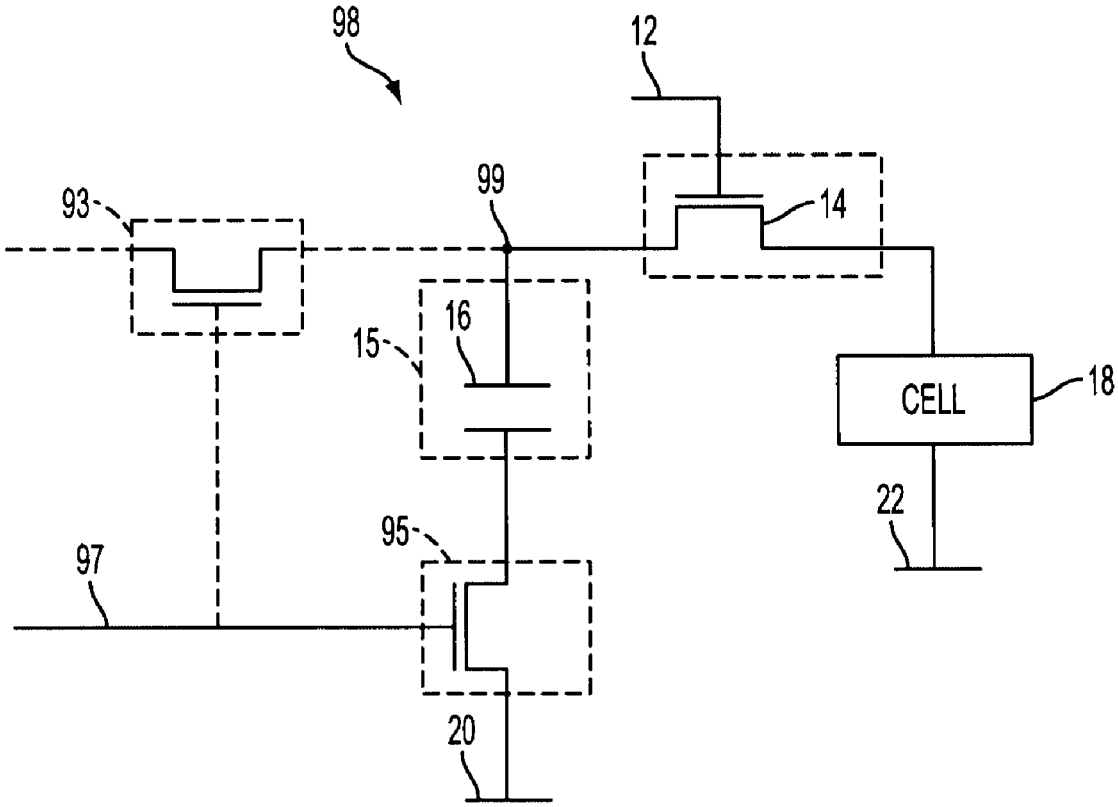
FIG. 6 is a schematic diagram of a pixel of a flash lamp according to another embodiment.

FIG. 6 is a schematic diagram of a pixel of a flash lamp according to another embodiment. In this embodiment, the pixel 98 has a structure similar to the pixel 10 of FIG. 2; however pixel 98 includes an additional switch 95 between the storage element 15 and the power source 20. The switch 95 can be actuated through control line 97. For example, switch 95 can be a transistor with control line 97 coupled to a corresponding gate of the transistor. Accordingly, the recharge of storage element 15 can be controlled on a per-pixel basis.

Although one particular configuration of per-pixel control of the recharging of the storage element 15 has been described, other configurations can be used. For example, a switch 93 can be coupled to node 99 between the storage element 15 and the switch 13. The storage element 15 can be recharged through actuation of switch 93. Regardless of the particular connections, referring to FIGS. 4 and 5, the controller 82 can be configured to be able to actuate each control line 97 individually. As a result, the pixels 98 can be individually recharged.

Although the term image-wise has been with reference to the pixels of the flash lamp 86 and with respect to an image transfer structure 84, the resolution, dot pitch, or other similar parameter of any image applied to the substrate 94, any capabilities of an image transfer structure 84, or the like can, but need not be the same as the pixels of the flash lamp 86. For example, the image transfer structure 84 can transfer an image at a resolution of 1200 dots per inch in two directions, yet the pixels of the flash lamp 86 can have a resolution of 30 pixels per inch in two directions. Yet the selective deposition of marking material and the selective energizing of the pixels can both be referred to as image-wise. That is, even though the particular functions operate at different resolutions, the functions need only be based on the image, not identical, to be considered image-wise. In an embodiment, the pattern of flash pixels is chosen to overfill the pattern of image pixels. However, such illumination is still image-wise as it is based on the deposited image.

It should be noted that image, image-wise, and the like can refer to the radiation generated by the flash lamp, the control of the flash lamp, or the like. In an embodiment, the pixels of the flash lamp can be independently controlled. As a result, an arbitrary array of pixels can be illuminated creating an image. That is, the image that is created is the radiation of the flash lamp, the projection of the radiation on a substrate, or the like due to the control of the pixels of the flash lamp. For example, in the context of irradiation of a biological sample, the image can be generated through the irradiation of one half of a sample. Thus, in this example, the image is one half of the flash lamp, regardless of the distribution of the biological sample. Moreover, even within the context of a deposited image as described above, the image-wise irradiation need not be based on the deposited image. For example, the image generated by the flash lamp can be dependent on a shape of a surface of the substrate, rather than the deposited image.

Referring back to FIG. 5, in an embodiment, the substrate 94 can be in motion due to the substrate transport system 88. A time for a desired transfer of energy to the substrate and/or marking material can be significant with respect to the pixel size of the flash lamp 86. That is, during the time for the energy transfer, a particular portion of the image may pass multiple pixels of the flash lamp 86. Accordingly, the controller 82 can be configured to image-wise energize the pixels to track the substrate 94. As a result, the image-wise irradiation of the substrate can travel along the flash lamp 86 synchronized with the motion of the substrate 94.

In an embodiment, the imaging system 80 can include a sensor 101. The sensor 101 can be configured to sense emissions from the flash lamp 86. Accordingly, the sensor 101 can be used to calibrate the flash lamp 86. For example, as described above, each pixel of the flash lamp 86 can be addressed individually. Through such individual addressing, controller 82 can be configured to actuate each pixel for different amounts of time. In another example, as described above, the storage elements of pixels can be individually charged. The controller 82 can be configured to vary the amount of charge on the storage elements.

In another example, the sensor 101 can be a sensor array such as a CMOS image sensor, a charge-coupled device (CCD) sensor, or the like can be used. In an embodiment, each pixel of the flash lamp 86 can be aligned with a sensor of the sensor array. As a result, each pixel of the flash lamp 86 can be calibrated from a corresponding sensor of the sensor array.

Regardless of how controlled, the energy outputs of the pixels can be measured by the sensor 101. In an embodiment, the measurements can be used to calibrate the flash lamp 86 such that each pixel emits a substantially similar amount of energy. However, in another embodiment, the flash lamp 86 can be calibrated such that each pixel emits a different amount of energy. For example, a particular substrate 94 and/or marking material can have areas of varying absorption, reflectivity, or the like. As a result, to achieve a substantially uniform transfer of energy, differing levels of energy can be emitted. That is, not only can the spatial emission from the flash lamp 86 be image-wise controlled, the intensity and emission time can also be image-wise controlled.

Although switches 13 have been described above for controlling whether a pixel is actuated, other techniques can be used. For example, the pixels of the flash lamp 86 can be coupled to the controller 82 through a passive-matrix style connection. Since the gas of a cell of a pixel must be ionized, there is a threshold voltage across the cell that must be exceeded before emission can occur. By selectively controlling the voltage on a column electrode, for example, the pixels can be selectively actuated when and only when the corresponding row electrode is activated.

In another embodiment, a total intensity from a portion and/or the entire flash lamp 86 can be digitally controlled. For example, from a group of n pixels 0-n pixels can be activated. Accordingly, the total intensity can be set to n levels.

Figure 7:
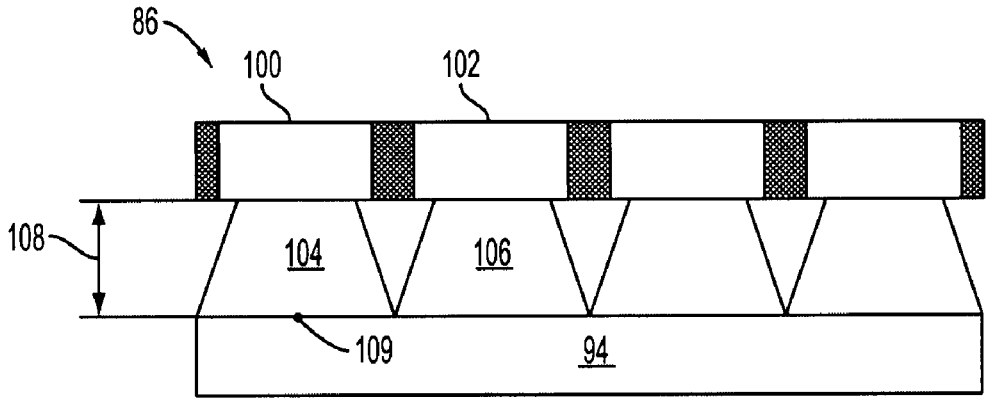
FIG. 7 is a block diagram illustrating an example of a near-field application of the flash lamp of FIG. 5.

FIG. 7 is a block diagram illustrating an example of a near-field application of the flash lamp of FIG. 5. As used herein, a near-field region of the flash lamp is a location relative to the flash lamp where a majority of the incident radiation at a particular location is generated by a single source. For example, referring to FIGS. 5 and 7, cells 100 and 102 generate volumes of light 104 and 106, respectively. The substrate 94 is at a distance 108 from the cells 100 and 102. At such a distance the majority of the incident light on any particular area of the substrate 94 is substantially dependent on a single cell. For example, at point 109 on the substrate 94, the majority of the incident light is generated from cell 100.

To utilize such a flash lamp 86, the substrate transport system 88 can be configured to dispose the substrate 94 in a near-field region of flash lamp 86. For example, belts, rollers, air jets, or the like can position the substrate 94 so that it is in the near-field region of the flash lamp 86.

Figure 8:
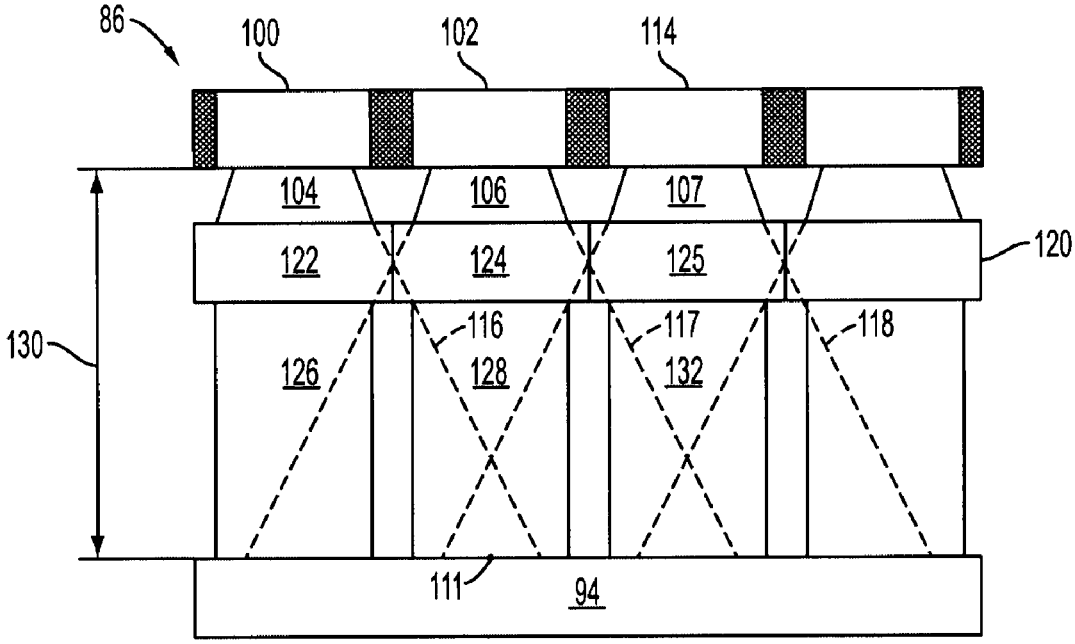
FIG. 8 is a block diagram illustrating an example of a far-field application of the flash lamp of FIG. 5.

FIG. 8 is a block diagram illustrating an example of a far-field application of the flash lamp of FIG. 5. Referring to FIGS. 5 and 8, in contrast to a near-field region as described above, a far-field region is a location relative to the flash lamp where at most, a minority of the incident radiation at a particular location is generated by a single source. In an embodiment, the substrate transport system 88 can be configured to dispose the substrate 94 in the far field region of the flash lamp. As a result, emissions from multiple cells, such as cells 100, 102, and 144 can overlap. Emission volumes 116, 117, and 118 represent the emissions from cells 100, 102, and 144, respectively. As illustrated, emission volumes 116, 117, and 118 overlap on the substrate 94 at location 111.

However, as the distance 130 increases, emissions from more and more cells will overlap, reducing the image-wise characteristic of the irradiation of the substrate 94. An optics array 120 can be configured to focus light emitted from the pixels. The optics array 120 can be any variety of optics that can focus the light emitted from the pixels. For example, the optics array 120 can be an array of lenses, with a lens per pixel. In another example, the optics array 120 can be an array of graded-index lenses.

Thus, in an embodiment, the optics array 120 focuses emissions 104, 106, and 107 using lenses 122, 124, and 125. Accordingly, emission volumes 126, 138, and 132 exiting from the optics array 120 are more collimated than the corresponding emission volumes 104, 106, and 107. As a result, the distance 130, placing the substrate 94 in a far-field region of the flash lamp can be greater than the near-field distance 108 of FIG. 7, yet the irradiation of the substrate 94 can maintain the resolution of the pixels of the flash lamp.

Although an optics array 120 has been described with reference to a far-field application, a far-field application need not include such optics. For example, the substrate transport system 88 can be configured to position the substrate 94 in a far-field region where multiple pixels contribute to the irradiation of any particular location of the substrate 84, yet all pixels do not contribute. Thus, although the effective resolution is decreased, the substrate 94 can still be image-wise irradiated.

In an embodiment, the cells 100, 102, 114, and the like can be spaced further from one another and the radiating areas of each cell can be small in lateral extent relative to the spacing between cells. At an appropriate location, the optics array 120 can collimate the emissions of the cells, approximating point sources, to create substantially overlapping irradiation of the substrate 94. That is, if the emissions of the cells were collimated shortly after the emission from the cells, the beam width of the collimated emission may not overlap. Accordingly, the optics array 120 can be selected and/or positioned such that the collimated emissions overlap to any desired extent.

Accordingly the optics array 120 can be used to shape the emissions of the cells into a desired spatial arrangement. That is, the optics array 120 is not limited to only collimating the emissions, but can be used to diffuse the emissions, aggregate emissions, or otherwise combine the emissions into a desired spatial arrangement. Moreover, the spatial arrangement can, but need not be static. For example, the optics array 120 can be configured to have differing focal lengths for differing substrates.

Figure 9:
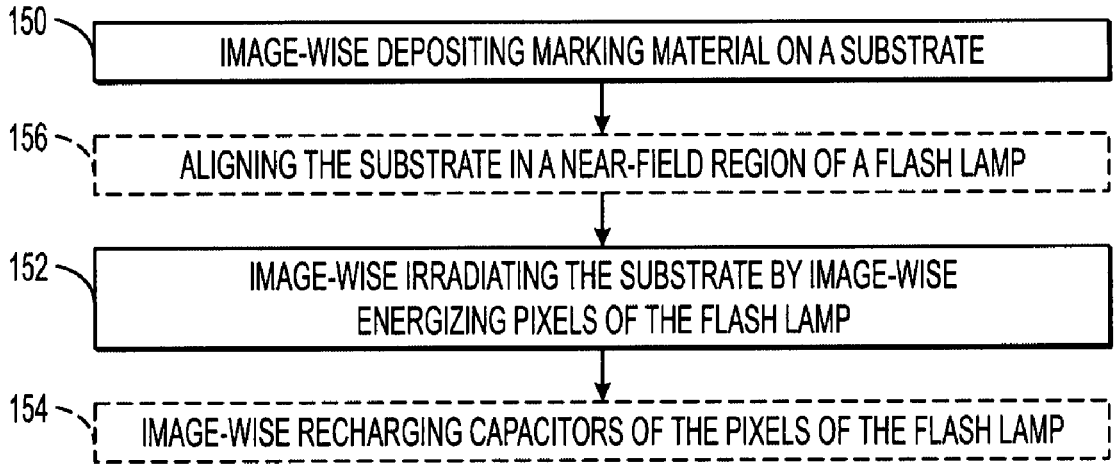
FIG. 9 is a flowchart illustrating a method of imaging using a flash lamp according to an embodiment.

FIG. 9 is a flowchart illustrating a method of imaging using a flash lamp according to an embodiment. An embodiment includes a method of imaging using a flash lamp including a plurality of pixels where each pixel includes a transparent first electrode; a cell including a gas; and a second electrode having a non-uniform surface. In 150, marking material is image wise deposited on a substrate. In 152, the substrate is image-wise irradiated to fuse the marking material to the substrate by image-wise discharging current through the cells.

As described above, the substrate can be moved into a near-field region of the flash lamp. Accordingly, in 156, the method can include aligning the substrate in a near-field region of the flash lamp.

Since the cells were image-wise discharged, charge storage elements of the cells are automatically image-wise recharged. For example, in 154, capacitors of the flash lamp are image-wise recharged. Accordingly, energy need only be expended on an image-wise basis and unmarked regions of the substrate are not unnecessarily heated and/or dried. Moreover, as described above, the recharging of storage elements can be switched. Accordingly, image-wise recharging the capacitors in 154 can be performed by image-wise switching on switches for charging the capacitors.

Although particular embodiments have been described, it will be appreciated that the principles of the invention are not limited to those embodiments. Variations and modifications may be made without departing from the principles of the invention as set forth in the following claims.

What is claimed is:

1. A flash lamp, comprising:

a plurality of pixels integrated with a printed circuit board back plane, each pixel including:

a transparent first electrode;

a cell including a gas coupled to the transparent first electrode; and a second electrode having a non-uniform surface coupled to the cell.

2. The flash lamp of claim 1, wherein:

each pixel further comprises a spacer between the transparent first electrode and the second electrode forming an opening; and the gas is disposed in the opening.

3. The flash lamp of claim 1, wherein each second electrode comprises a plurality of nano-wires.

4. The flash lamp of claim 1, wherein the plurality of pixels is a hermetically sealed pixel array.

5. The flash lamp of claim 1, wherein each pixel further comprises an addressable switch coupled to the second electrode.

6. The flash lamp of claim 5, wherein each pixel further comprises a capacitor coupled between the switch and a power electrode.

7. The flash lamp of claim 1, further comprising an optics array configured to spatially control light emitted from the pixels.

8. The flash lamp of claim 1, wherein for at least one pixel, the first electrode and the second electrode are disposed such that the pixel is matrix addressable.

9. The flash lamp of claim 1, wherein each pixel further comprises:

a storage element coupled to the cell; and a switch coupled between the storage element and a power source.

10. The flash lamp of claim 1, further comprising:

a sensor disposed to receive emissions from the pixels; and a controller configured to control a discharge through the pixels in response to the sensor.

11. An imaging system, comprising:

an image transfer structure configured to image-wise apply marking material to a substrate; and a flash lamp configured to fuse the marking material to the substrate, the flash lamp including:

a plurality of flash lamp pixels, each flash lamp pixel including:

a transparent first electrode;

a cell including a gas coupled to the transparent first electrode; and a second electrode having a non-uniform surface coupled to the cell.

12. The imaging system of claim 11, further comprising a substrate transport system configured to dispose the substrate in a near-field region of flash lamp.

13. The imaging system of claim 11, further comprising a substrate transport system configured to dispose the substrate in a far-field region of flash lamp.

14. The imaging system of claim 11, further comprising a controller configured to image-wise energize the pixels.

15. The imaging system of claim 11, further comprising a controller configured to image-wise translate emissions of the pixels.

16. The imaging system of claim 11, wherein each pixel includes at least one addressable switch.

17. The imaging system of claim 11, wherein each pixel includes a capacitor.

18. A method of imaging using a flash lamp, comprising a plurality of pixels, each pixel including a transparent first electrode; a cell including a gas; and a second electrode having a non-uniform surface, the method comprising:

image-wise depositing marking material on a substrate; and image-wise irradiating the substrate to fuse the marking material to the substrate by image-wise discharging current through the cells.

19. The method of claim 18, wherein each of the pixels of the flash lamp includes a capacitor, the method further comprising image-wise discharging the capacitors.

* * * * *